US006838967B2

(12) United States Patent
Martin

(10) Patent No.: US 6,838,967 B2
(45) Date of Patent: Jan. 4, 2005

(54) SUPPORT SURFACE THAT UTILIZES MAGNETIC REPULSIVE FORCES

(76) Inventor: Michael Martin, 307H NE. 85$^{th}$ St., Vancouver, WA (US) 98665-8041

( * ) Notice: Subject to any disclaimer, the term of this patent is extended or adjusted under 35 U.S.C. 154(b) by 10 days.

(21) Appl. No.: 10/161,263

(22) Filed: Jun. 3, 2002

(65) Prior Publication Data

US 2003/0222741 A1 Dec. 4, 2003

(51) Int. Cl.$^{7}$ ..... H01H 7/02
(52) U.S. Cl. ..... 335/306; 335/285
(58) Field of Search ..... 335/302–306, 335/285, 205–207; 310/12; 248/638; 269/8

(56) References Cited

U.S. PATENT DOCUMENTS 4,585,282 A 4/1986 Bosley
4,595,166 A * 6/1986 Kurokawa ..... 248/559
5,631,617 A * 5/1997 Morishita ..... 335/216
5,780,943 A * 7/1998 Ono ..... 310/12
6,040,675 A * 3/2000 Ono ..... 318/649
6,261,515 B1 7/2001 Ren et al.
6,302,939 B1 10/2001 Rabin et al.
6,319,334 B1 11/2001 Ohashi et al.
6,437,864 B1 * 8/2002 Watanabe et al. ..... 356/399

* cited by examiner

*Primary Examiner*—Lincoln Donovan
(74) *Attorney, Agent, or Firm*—Fraser Martin Buchanan Miller LLC; J. Matthew Buchanan

(57) ABSTRACT

A support surface that utilizes repulsive forces of opposing magnetic fields is described. In preferred embodiments, the support apparatus includes first and second frame members having first and second pluralities of magnets disposed thereon. The pluralities of magnets are oriented such that the first plurality of magnets produces a magnetic field having an orientation that opposes the magnetic fields of the magnets of the second plurality. The first and second frame members interact such that they maintain a substantially static lateral position relative to each other despite the repulsive forces of the opposing magnetic fields. A support member, such as a cushion member, is disposed adjacent one of the frame members, and can be connected thereto. A covering can surround the entire assembly. In particularly preferred embodiments, the frame members have dimensions similar to those of conventional mattresses, and the cover confers the appearance of a conventional mattress onto the support apparatus.

10 Claims, 8 Drawing Sheets

SUPPORT SURFACE THAT UTILIZES MAGNETIC REPULSIVE FORCES

FIELD OF THE INVENTION

The present invention relates to apparatuses for supporting portions or entire bodies of individuals. The support apparatuses of the present invention utilize opposing magnetic fields to provide at least some of the support to the body or a portion thereof. In a specific embodiment, the present invention relates to a support apparatus for supporting a human being while sleeping.

BACKGROUND OF THE INVENTION

Human beings, like many animals, prefer to lie down while sleeping. Lying down allows the body to relax, and therefore provides better rest to the body. Throughout history, people have experimented with different types of support surfaces in attempts to provide increased comfort and better rest during sleep. As a result, many different forms of sleeping support services are readily available from commercial sources in modern times. Examples of currently available support surfaces includes conventional mattresses that have support frames and a plurality of spring beneath a cushion member, water mattresses that comprise a bladder filled with fluid, and air mattresses that comprise a chamber filled with air.

Despite these availability of these and other various types of support surfaces, drawbacks remain in the field. For example, currently available types of support surfaces can be simply uncomfortable for some people. Furthermore, some of the support surfaces, such as conventional mattresses having numerous metal springs in addition to padding, can be heavy and cumbersome. Also, other types requires significant maintenance, such as waterbeds, or require the user to expend significant time in setting up the surface prior to use, such as inflatable air mattresses.

Thus, a need exists for a comfortable support surface that overcomes these and other problems present in the prior art.

SUMMARY OF THE INVENTION

The present invention provides a support apparatus for supporting at least a portion of an individual. In preferred embodiments, the present invention provides an apparatus for supporting a human being during sleep. The apparatuses of the present invention utilize repulsive forces of opposing magnetic fields to support at least a portion of the body weight of an individual.

The support apparatuses of the present invention can offer several advantages over those apparatuses found in prior art. For example, for some individuals, the apparatuses of the present may provide increased comfort during sleep. The comfort can be increased over that as typically associated with conventional spring-based mattresses, but is not associated with the drawbacks of water and air mattresses, such as the maintenance and setup and taken down problems mentioned above.

In one preferred embodiment, the support apparatus according to the present invention comprises first and second frame members connected to each other in such a manner that at least a portion of the second frame member is substantially parallel to at least a portion of the first frame member. A first plurality of magnets is disposed on the first frame member, and a second plurality of magnets is disposed on the second frame member. Each of the first plurality of magnets has a magnetic field in a first orientation, and each of the second plurality of magnets has a second magnetic field in a second orientation that opposes the orientation of the first magnetic field. A body support surface is disposed on the second frame member. The body support surface is supported at least in part due to the opposing, i.e. repulsive, forces of the first and second plurality of magnets.

In another preferred embodiment, a support apparatus according to the present invention comprises a frame having first and second frame members and a plurality of connectors that secure the first frame member to the second frame member. Each of the first and second frame members comprise a plurality of outer members and at least one inner member that spans from a first outer member to a second outer member. The first plurality of magnets is disposed on at least one inner member of the first frame member, and a second plurality of magnets is disposed on at least one inner member of the second frame member. The magnetic fields of the second plurality of magnets have an orientation that is substantially opposite the magnetic fields of the first plurality of magnets. Also, at least one spacing member, such as a foam member, is disposed between the inner members of the first and second frame members. A body support surface is disposed on the second frame member, and a covering surrounds the frame and the body support surface.

DETAILED DESCRIPTION OF THE INVENTION

While the invention is defined by the claims appended hereto, a more complete understanding of the invention can be obtained by referencing the following detailed description of preferred embodiments and the accompanying drawings. The following description of preferred embodiments of the invention provides examples of the present invention. The embodiments discussed herein are merely exemplary in nature, and are not intended to limit the scope of the invention in any manner. Rather, the description of these preferred embodiments serves to enable a person of ordinary skill in the relevant art to make and use the present invention.

Figure 1:
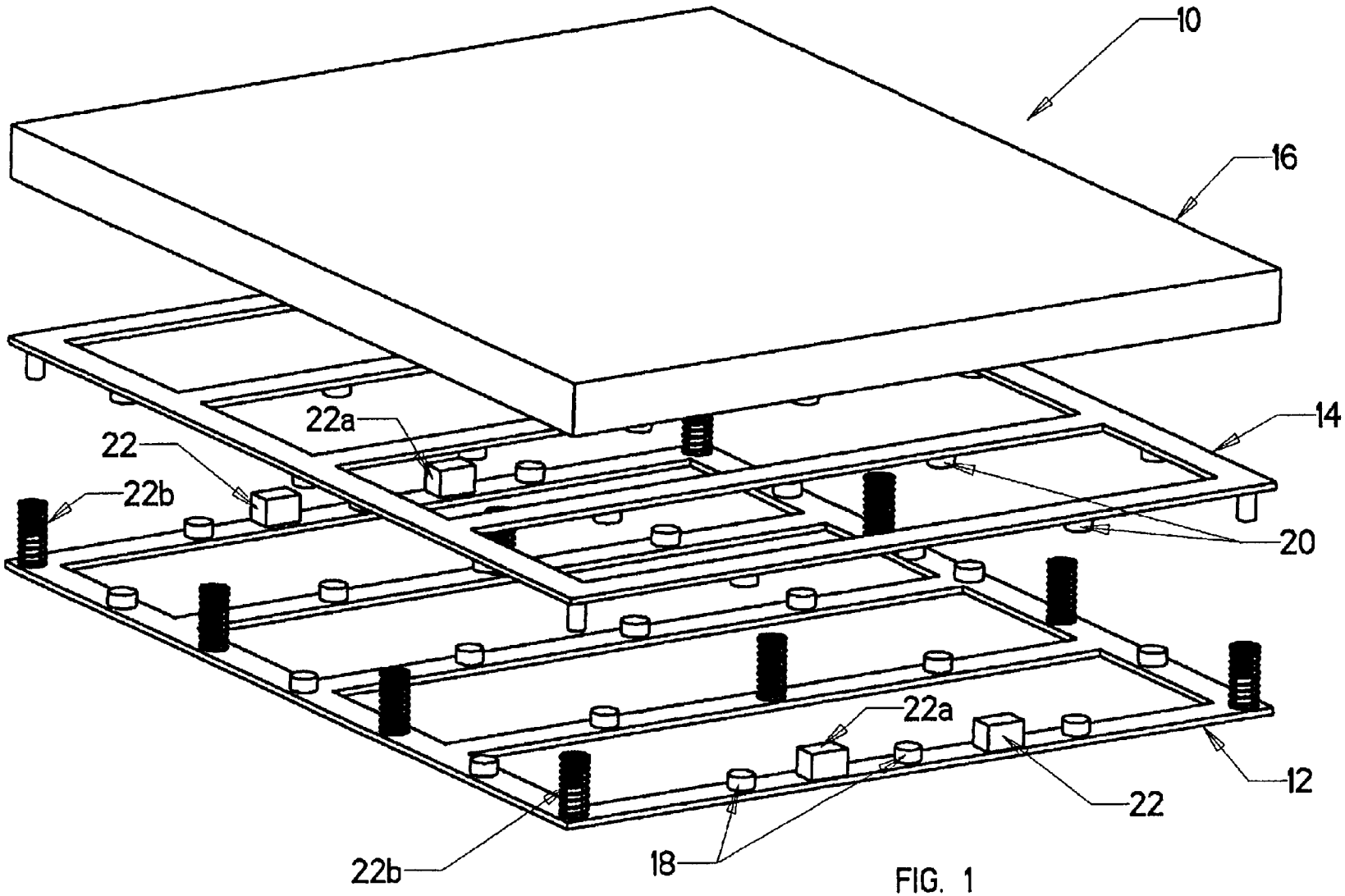
FIG. 1 is an exploded view of a support apparatus according to a first preferred embodiment of the present invention.
Figure 2:
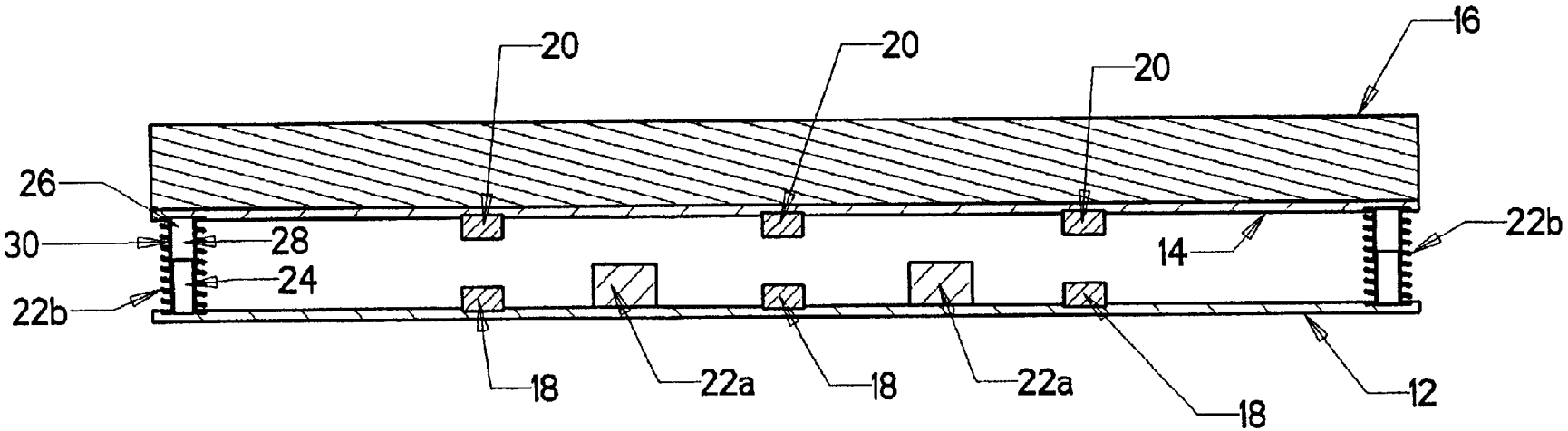
FIG. 2 is a cross-sectional view of the support apparatus according to the first preferred embodiment.
Figure 3:
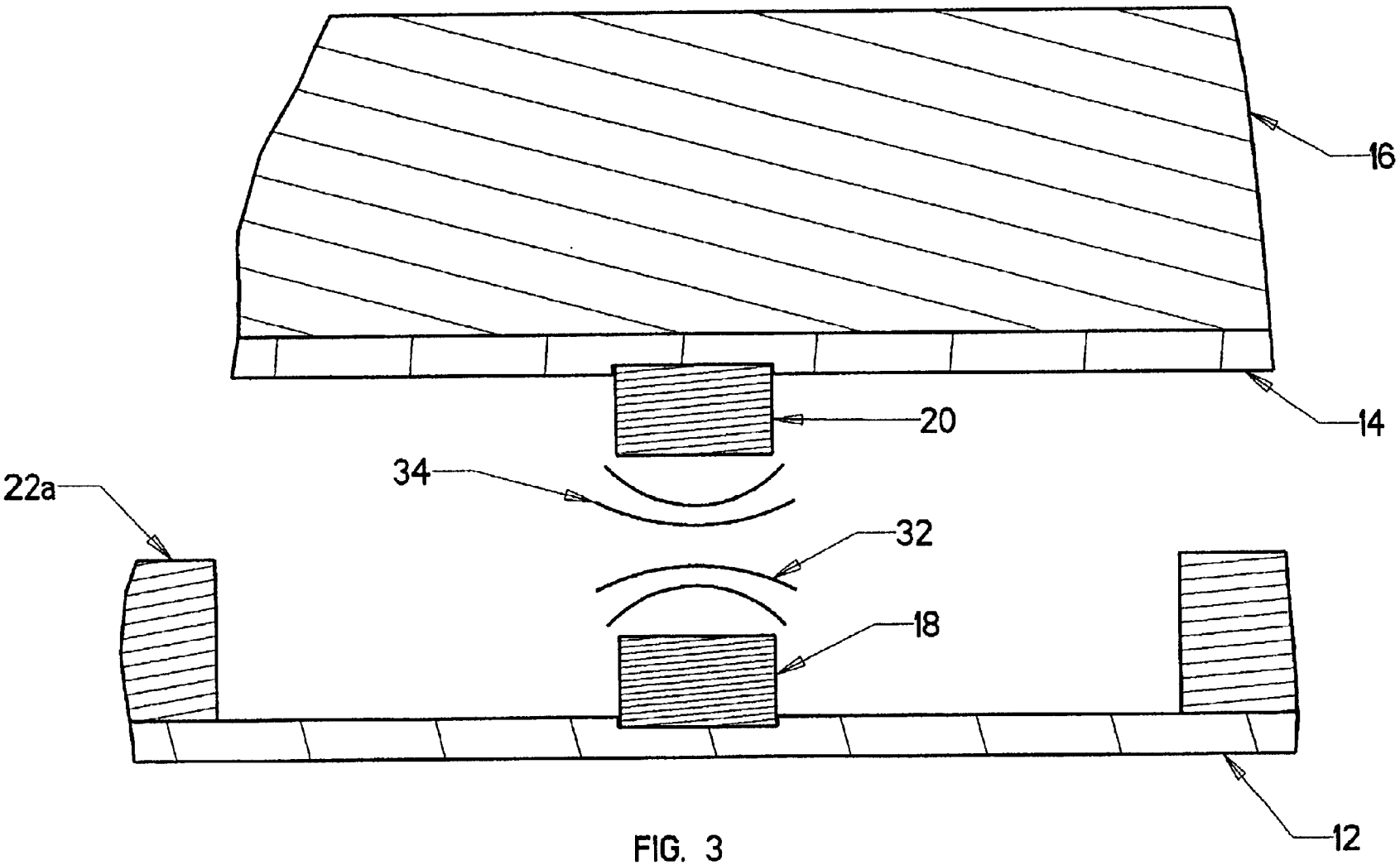
FIG. 3 is a detailed view of area I illustrated in FIG. 2.

FIGS. 1, 2, and 3 illustrate a support apparatus according to a first preferred embodiment of the present invention. The support apparatus, generally illustrated in the Figures as reference 10, comprises a first frame member 12, a second frame member 14, and a body support surface 16. A first plurality of magnets 18 is disposed on the first frame member, and a second plurality of magnets 20 is disposed on the second frame member 14. One or more spacing members 22 can be disposed on one or both of the frame members 12, 14.

As best illustrated in FIG. 1, the first 12 and second 14 frame members are preferably complementary to each other, having similar configurations. The frame members 12, 14 can be formed from any suitable material, and preferred materials include wood and plastic. Metal frame members can also be used so long as the magnets 18, 20 are adequately secured to the appropriate frame member 12, 14 to prevent migration of the magnets 18, 20 due to attraction to the opposite frame member 12, 14.

As best illustrated in FIG. 2, the first frame member 12 is arranged relative to the second frame member 14 such that at least a portion of the second frame member 14 is substantially parallel to at least a portion of the first frame member 12. Particularly preferably, the entire second frame member 14 is substantially parallel to the entire first frame member 12. Also, connection between the frame members 12, 14 is necessary to counteract any lateral movement of the frame members 12, 14 that might occur due to the repulsive forces of the opposing pluralities of magnets 18, 20. Accordingly, any suitable connection between the frame members 12, 14 can be utilized.

FIG. 2 illustrates a particularly preferred connection between the frame members 12, 14. In this embodiment, the first frame member 12 defines a projection 24 and the second frame member 14 defines a receptacle 26 adapted to receive the projection 24. The projection 24 can define a mechanical stop, such as pin 28 that is slidably received by slot 30 of the receptacle 26. This arrangement allows vertical movement of the second frame member 14 relative to the first frame member 12, while providing the necessary limit on lateral movement of the frame members 12, 14 due to the repulsive forces of the magnets 18, 20.

Also as best illustrated in FIG. 2, one or more spacing members 22 can be disposed between the frames 12, 14 to provide support in addition to that provided by the repulsive forces of the magnets 18, 20. Any suitable spacing member can be utilized, but the spacing member 22 preferably provides support while allowing vertical movement of the second frame member 14 relative to the first frame member 12. Accordingly, preferred spacing members include foam members, such as blocks of open cell foam that can be compressed, and springs. As best illustrated in FIG. 1, a plurality of foam members 22*a* are preferably used in conjunction with a plurality of springs 22*b*. However, it is to be understood that a single type of spacing member can be utilized.

The body support surface 16 provides a surface suitable for supporting at least a portion of a body of an individual, and preferably comprises a surface support suitable for supporting an entire human being. Also, the body support surface 16 provides a comfortable surface for providing such support. Accordingly, the body support surface 16 preferably comprises a cushion member, such as a block of foam or section of fabric. Furthermore, any other suitable mattress-type surface can be used as the body support surface 16. Examples of suitable surfaces include sealed air chambers, fluid filled bladders, and conventional enclosed mattresses.

The first 18 and second 20 pluralities of magnets are preferably identical to each other except in the orientation of their respective magnetic fields. To provide the desired support, the first plurality of magnets 18 each has a magnetic field that substantially opposes the individual magnetic fields of each of the second plurality of magnets 20. This is best illustrated in FIG. 3 where the first magnetic field 32 of a magnet of the first plurality 18 substantially opposes a second magnetic field 34 of a magnet of the second plurality 20. This opposition of magnetic fields provides the force that the support apparatus 10 of the present invention utilizes to support at least a portion of a body of an individual.

As illustrated in FIG. 1, the magnets 18, 20 are preferably arranged about the appropriate frame members 12, 14 in a regular pattern. To protect against unintended movement of the magnets due to the repulsive forces of the opposing fields, the magnets 18, 20 are preferably secured to the appropriate frame member 12, 14 by any suitable means, such as adhesive or mechanical connection. Also as illustrated in FIG. 1, the magnets 18, 20 are preferably arranged such that a magnet from the first plurality 18 directly opposes a magnet from the second plurality 20. That is, a magnet from the first plurality 18 is placed directly below a magnet from the second plurality 20, producing maximum repulsion due to opposing magnetic fields. While this arrangement is preferred, it is not necessary. Indeed, based on the type of magnet utilized, the number of magnets utilized, and the expected mass of the body portion to be supported, suitable and optimal arrangements of magnets 18,20 can be determined and utilized.

Any suitable magnet can be utilized in the present invention, and need only be able to provide a magnetic field that, when opposed to another magnetic field, provides a sufficient repulsive force to provide the desired support. Preferably, the magnets 18, 20 are selected in size, shape, and number such that the repulsive forces between the first plurality 18 and second plurality 20 are sufficient to provide at least some support to the body portion of interest. The amount of supportive force needed to be provided by the magnets will depend upon several factors, including the size, shape, type and number used, the typical mass of the body portion to be supported, and the presence or absence and number of spacing members 22 in the apparatus 10. The number of magnets can then be determined based on the desired support and strength of magnetic field for the magnet(s) chosen.

In the preferred embodiment, the support apparatus 10 according to the present invention comprises a mattress for supporting the entire body of an individual while at rest. In this embodiment, illustrated in FIG. 1, the pluralities of magnets 18, 20 preferably comprise numerous magnets spaced at regular intervals over the entirety of the appropriate frame member 12, 14. The size of the magnet will depend on the strength of the magnetic field possessed by the magnet. At least one member of the first plurality of magnets 18 comprises a rare earth magnet. These magnets are well known in the art, and are described in various United States patents, including U.S. Pat. No. 6,319,334 to Ohashi, et al. for RARE EARTH/IRON/BORON-BASED PERMANENT MAGNET AND METHOD FOR THE PREPARATION THEREOF; U.S. Pat. No. 6,302,939 to Rabin, et al. for a RARE EARTH PERMANENT MAGNET AND METHOD FOR MAKING SAME; and U.S. Pat. No. 6,261,515 to Ren, et al. for METHOD FOR PRODUCING RARE EARTH MAGNET HAVING HIGH MAGNETIC PROPERTIES. All of these references are hereby incorporated into this disclosure in their entirety.

Neodymium Iron Boron (NdFeB) and Samarium Cobalt (SmCo) magnets represent two distinct types of rare earth magnets. In the present invention, NdFeB magnets are preferred as they are the strongest of the two and, indeed, are the strongest of all permanent magnets.

Figure 4:
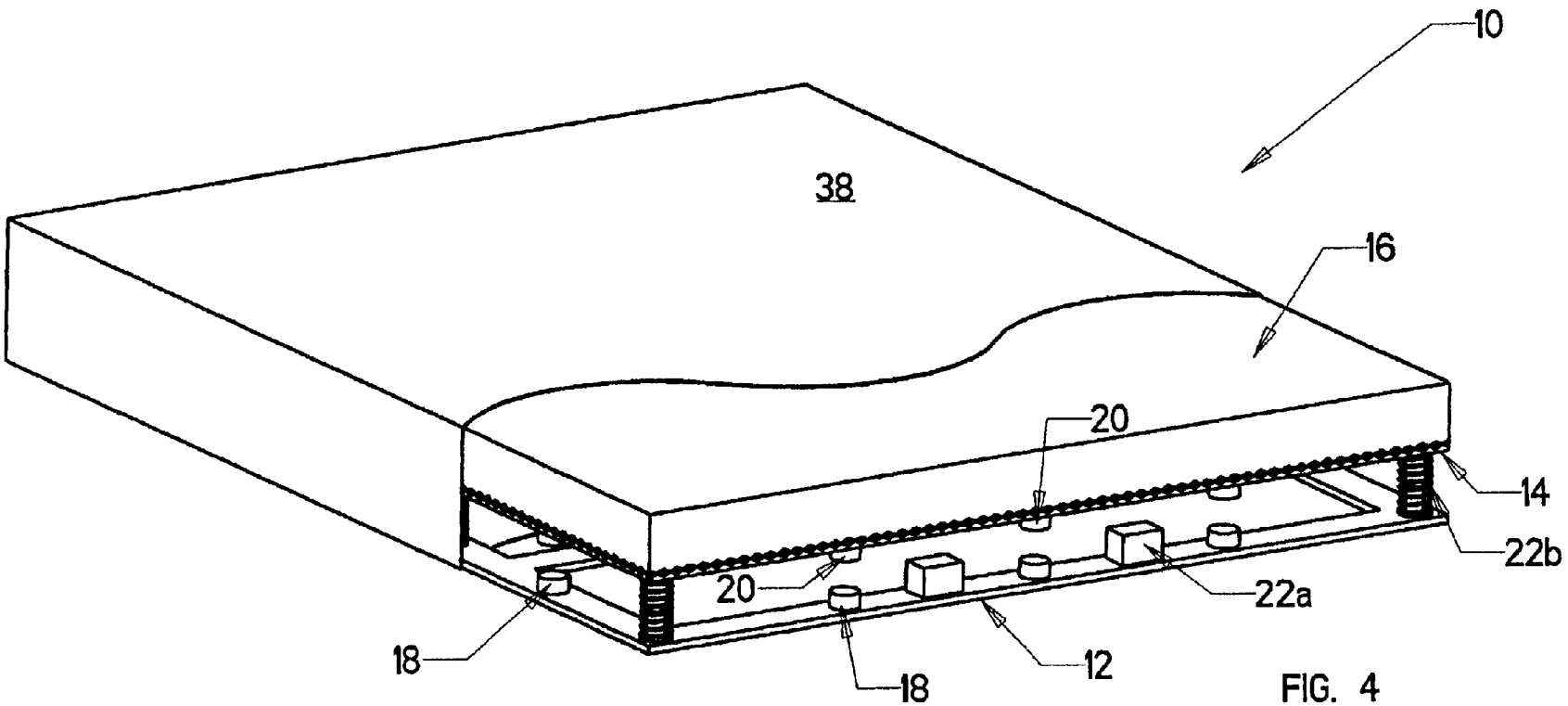
FIG. 4 is a perspective view of a support apparatus according to a second preferred embodiment of the present invention.

FIG. 4 illustrates the support apparatus 10 according to a second preferred embodiment of the present invention. In this embodiment, the body support surface 16 is secured to the second frame member 14. Any suitable means can be utilized for making this securement between the support surface 16 and the frame member 14. As illustrated in FIG. 4, a stitching 36 between the support surface 16 and the second frame member 14 is preferred. Other suitable securement means include staples and other mechanical securements known in the art.

Also in this embodiment, a covering 38 surrounds the first frame member 12, the second frame member 14, and the body support surface 16. In FIG. 3, the covering 38 is shown partially broken away to illustrate the other components of the support apparatus 10. In final form, however, the covering 38 extends completely around the support apparatus 10. In this embodiment, the covering 38 provides a uniform look to the support apparatus, and also provides a top surface onto which a user can place his or her body for support.

Considering the close proximity in which the covering 38 will be utilized with the body or body portion of a user, the covering is preferably formed from a comfortable material that provides a suitable support surface. Accordingly, the covering 38 is preferably comprised of a fabric, such as cotton, that provides a comfortable feeling to a user. The covering 38 can incorporate additional support materials, such as foam inserts or other materials known in the art.

Figure 5:
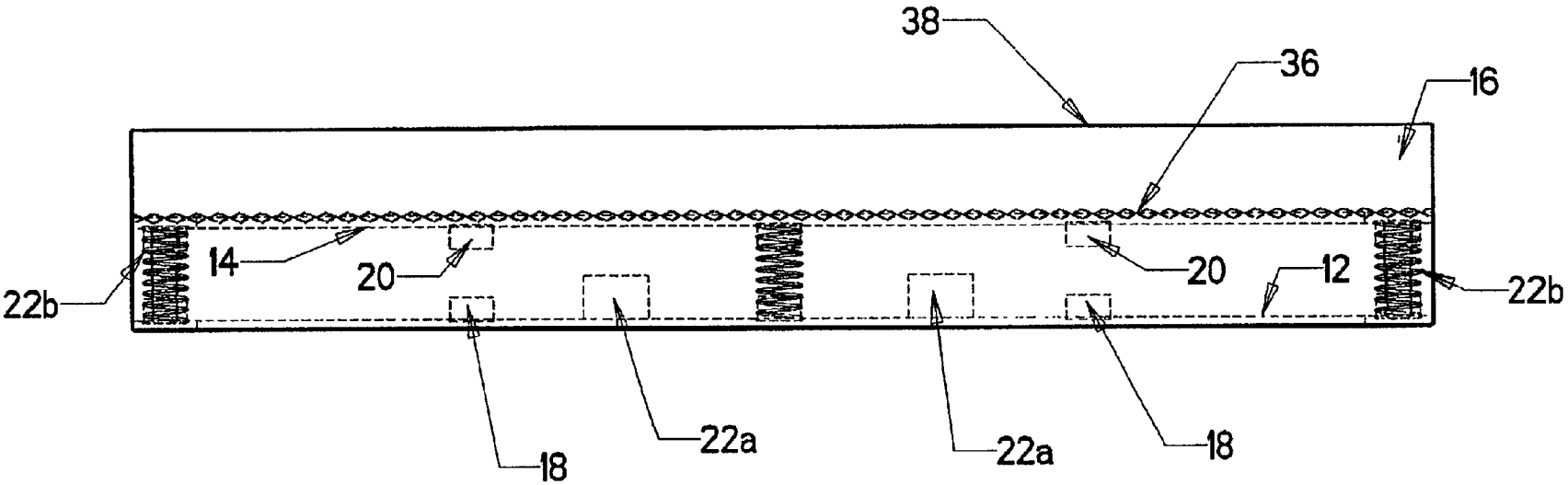
FIG. 5 is an end view of the support apparatus illustrated in FIG. 4 of the present invention.

As illustrated in FIG. 5, stitching 36 or other suitable securement means secure the support surface 16 to the second frame member 14, as in the first preferred embodiment.

Figure 6:
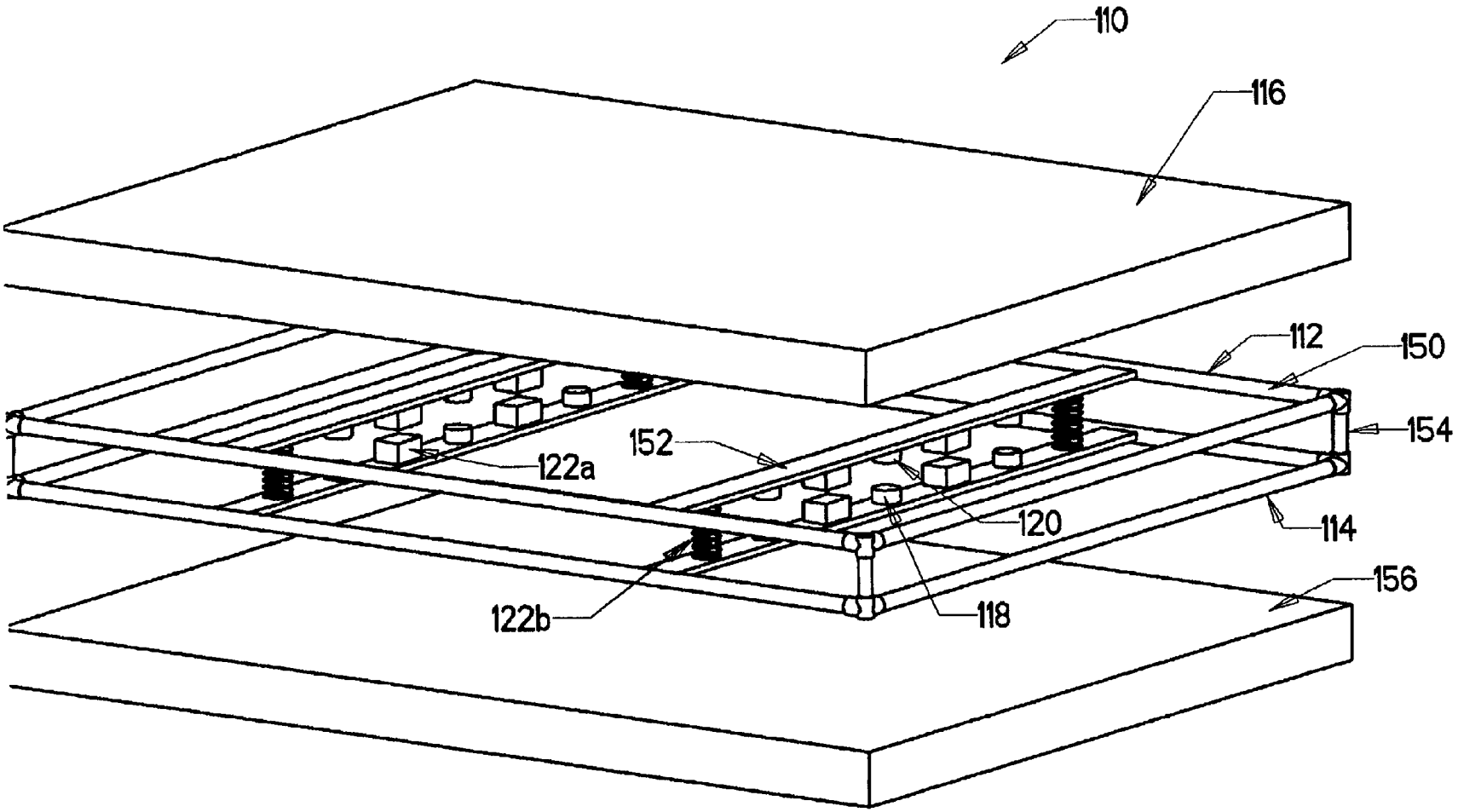
FIG. 6 is an exploded view of a support apparatus according to a third preferred embodiment of the present invention.
Figure 7:
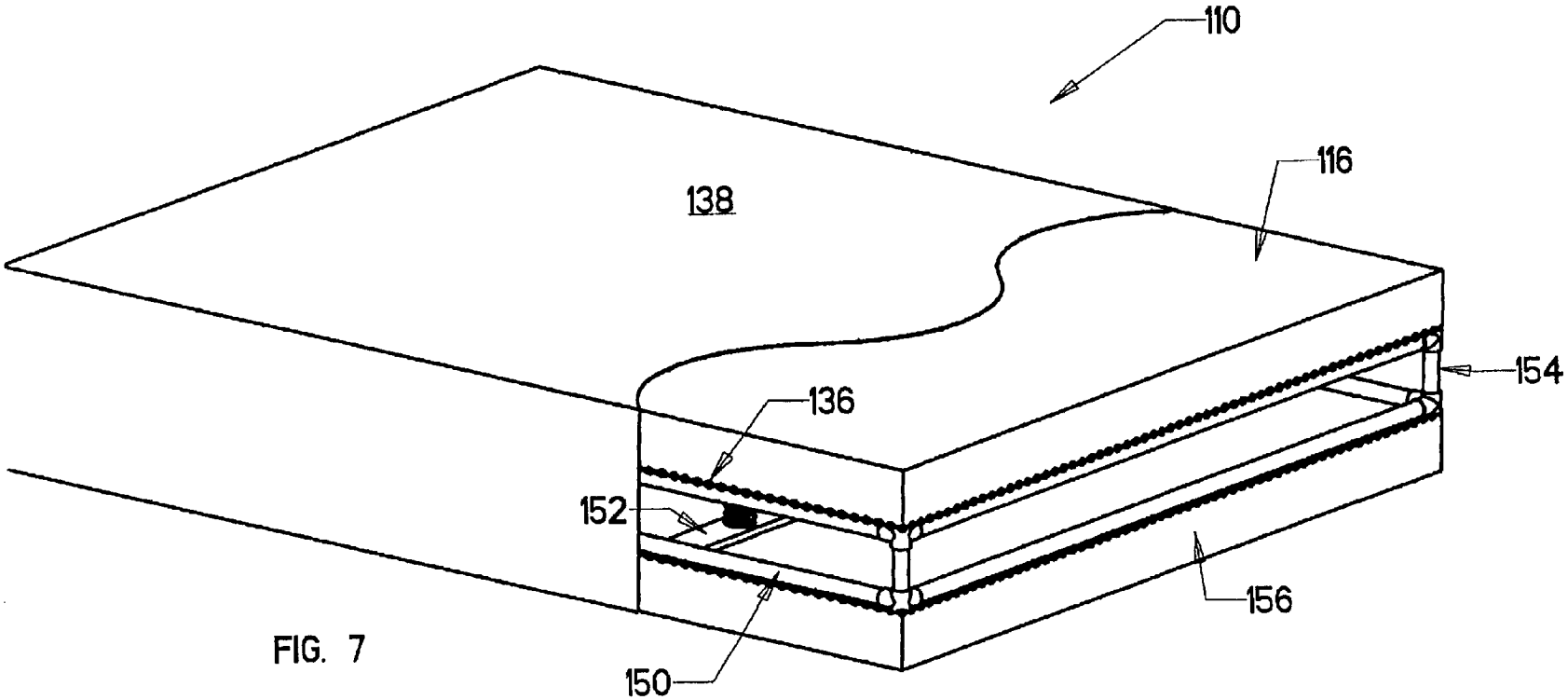
FIG. 7 is a perspective view of the support apparatus illustrated in FIG. 6 of the present invention.
Figure 8:
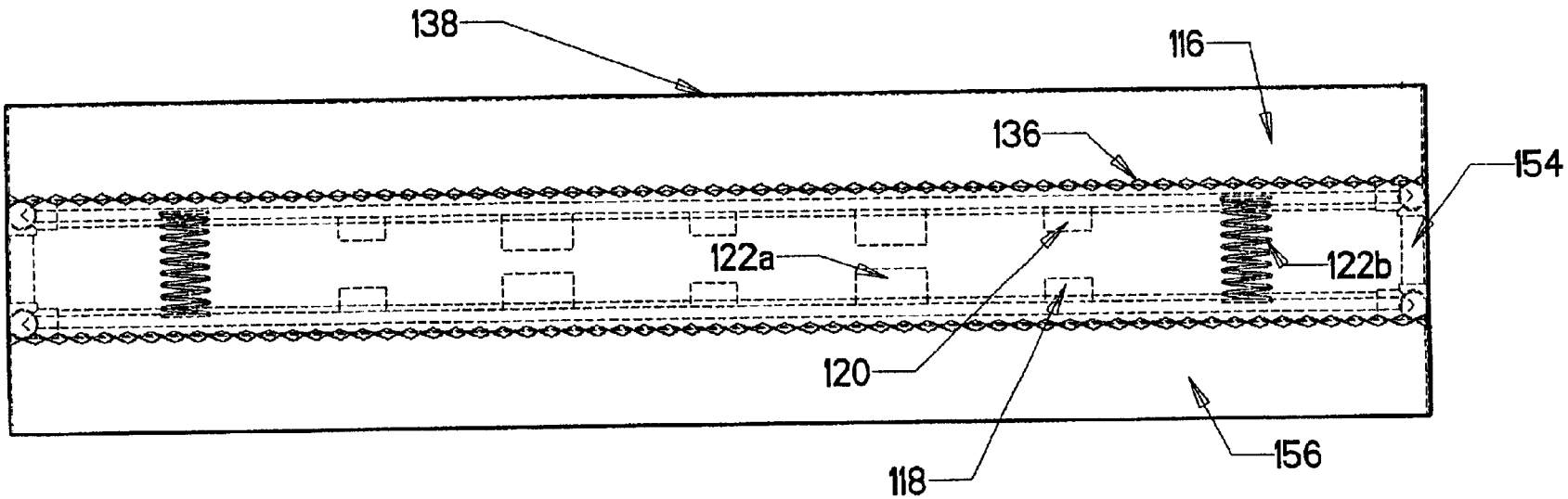
FIG. 8 is an end view of the support apparatus illustrated in FIG. 7 of the present invention.

FIGS. 6, 7, and 8 illustrate a third preferred embodiment of a support apparatus according to the present invention. This embodiment is similar to the first preferred embodiment, and thus similar reference numbers in FIGS. 6, 7, and 8 refer to similar features and/or components illustrated in FIGS. 1 through 5. Accordingly, the support apparatus in this embodiment is generally referred to as reference numeral 110.

The support apparatus 110 according to this embodiment includes a first frame member 112, a second frame 114, a body support surface 116, a first plurality of magnets 118, a second plurality of magnets 120, and can also include one or more spacing members 122.

The first 112 and second 114 frame members preferably comprise a plurality of outer members 150 and at least one inner member 152 spanning from a first outer member 150 to a second outer member 150. The first plurality of magnets 118 is preferably disposed on at least one inner member 152 of the first frame member 112, while the second plurality of magnets 120 is preferably disposed on at least one inner member 152 of the second frame member 114.

Also, a plurality of connectors 154 secure the first frame member 112 to the second frame member 114. In this embodiment, the connectors 154 preferably comprise members that define a plurality of openings for receiving outer members 150 of the appropriate frame member 112, 114.

Also in this embodiment, the support apparatus 110 also preferably includes a second body support surface 156. The second body support surface 156 provides a reversible configuration to the support apparatus 110, allowing an individual to utilize either the first 116 or second 156 body support surfaces. Accordingly, the second body support surface 156 is preferably identical to the first body support surface 116. As best illustrated in FIGS. 7 and 8, both body support surfaces 116, 156 are preferably secured to the appropriate frame member 112, 114 in any suitable manner, such as by stitching 136. Also, as best illustrated in FIG. 7, a covering 138 preferably surrounds the entire support apparatus 110, including the first 112 and second 114 frame members, and the first 116 and second 156 body support surfaces. In this embodiment, the support apparatus 110 is completely reversible in both form and appearance.

The foregoing disclosure includes the best mode devised by the inventor for practicing the invention. It is apparent, however, that several variations in the apparatuses of the present invention may be conceivable by one skilled in the art. Inasmuch as the foregoing disclosure is intended to enable one skilled in the pertinent art to practice the instant invention, it should not be construed to be limited thereby, but should be construed to include such aforementioned variations.

What is claimed is:

1. A support apparatus for supporting at least a portion of a body of an individual, said support apparatus comprising:

a first frame member;

a first plurality of magnets disposed on said first frame member, each of said first plurality of magnets having a first magnetic field;

a second frame member connected to said first frame member such that at least a portion of said second frame member is substantially parallel to at least a portion of said first frame member;

a second plurality of magnets disposed on said second frame member, each of said second plurality of magnets having a second magnetic field; and a compressible body support surface disposed on said second frame member;

wherein each of said first plurality of magnets has said first magnetic field in a first orientation;

wherein each of said second plurality of magnets has said second magnetic field in a second orientation; and wherein said first orientation opposes said second orientation.

2. The support apparatus of claim 1, further comprising at least one spacing member disposed between said first and said second frame members.

3. The support apparatus of claim 2, wherein said at least one spacing member comprises a foam member.

4. The support apparatus of claim 2, wherein said at least one spacing member comprises a spring.

5. The support apparatus of claim 2, wherein said at least one spacing member comprises a plurality of spacing members; and wherein said plurality of spacing members comprises at least one foam member and at least one spring.

6. The support apparatus of claim 1, further comprising a covering surrounding said first frame member, said second frame member, and said body support surface.

7. The support apparatus of claim 1, wherein said body support surface is secured to said second frame member.

8. The support apparatus of claim 1, wherein said body support surface is a cushion member.

9. The support apparatus of claim 1, wherein at least one of said first plurality of magnets comprises a rare earth magnet.

10. The support apparatus of claim 9, wherein at least one of said second plurality of magnets comprises a rare earth magnet.

* * * * *